United States Patent [19]

Brochier

[11] 3,997,697

[45] Dec. 14, 1976

[54] FABRIC WITH BORON FILAMENTS

[75] Inventor: Jean Brochier, Villeurbanne, France

[73] Assignees: J. Brochier & Fils, Villeurbanne; Avions Marcel Dassault-Breguet Aviation, Societe Anonyme Francaise ayant son siege Social, Paris, both of France

[22] Filed: Mar. 27, 1975

[21] Appl. No.: 562,855

Related U.S. Application Data

[63] Continuation of Ser. No. 358,879, May 10, 1973, abandoned.

[52] U.S. Cl. ..... 428/259; 139/426 R; 244/123; 428/260; 428/290; 428/366; 428/902

[51] Int. Cl.[2] ..... D03D 15/00

[58] Field of Search ..... 428/228, 257, 258, 259, 428/289, 290, 366, 367, 902; 139/420, 426; 244/123; 427/379

[56] References Cited

UNITED STATES PATENTS

| | | | |
|---|---|---|---|
| 3,558,350 | 1/1971 | Fincke | 427/379 |
| 3,565,127 | 2/1971 | Nicely | 139/426 R |
| 3,599,679 | 8/1971 | Carter | 139/420 R |
| 3,819,461 | 6/1974 | Saffadi | 428/902 |

*Primary Examiner*—James J. Bell
*Attorney, Agent, or Firm*—Karl F. Ross; Herbert Dubno

[57] ABSTRACT

A fabric comprising warp and woof (weft) has dense and strong boron fibers and boron-compound fibers constituting the weft and utilizes an open warp having a supportive function for the boron weft thereby obtaining high strength in the weft direction.

7 Claims, 3 Drawing Figures

FABRIC WITH BORON FILAMENTS

CROSS REFERENCE TO RELATED APPLICATIONS

This application is a continuation of application filed May 10, 1973, Ser. No. 358,879 now abandoned.

FIELD OF THE INVENTION

The present invention relates to a fabric containing boron filaments and threads and to structures containing same. The invention also relates to industrial fabric systems having high strength in at least one direction.

BACKGROUND OF THE INVENTION

In the construction of fabrics for industrial use, there are used so-called unidirectional fabrics, which confer a maximum modulus of elasticity in a particular direction, the unidirectional fabric being sandwiched between layers, e.g. synthetic-resin foils. These unidirectional fabrics are generally woven from fiberglass filaments, although, the easy fusibility of glass prevents use of such materials in high temperature applications, i.e. refractory applications such as in steel mills, foundries and the like.

Many new type fibers and materials have been proposed and laminated elements containing same have shown improvement of the order of 5 – 10 times in various physical properties, as compared to the usual fiberglass re-inforced structure using a synthetic resin.

Attempts have been made to utilize the very superior moduli, tensile strength and refractoriness of boron and boron-compounds (collectively described as boron threads or filaments) which melt at very high temperatures, and therefore display superior refractory character in the extreme high temperature environments found near hearths, furnaces, cupolas, steel converters, rolling mills, kilns and ore-roating operations. Especially disadvantageous tensile strength is found in boron whiskers.

Attempts to overcome the fragility and difficult pliability and workability of boron threads have been generally unsuccessful.

It has been proposed to solve the problem of the poor handling characteristics and workability of boron threads to provide them in the form of tapes, bands or strips with an average density of 80 threads per transverse centimeter and a width of 7 mm or greater, impregnated with epoxy or other settable resins, and to form laminated structures from a number of such bands or such bands in combination with other web-forming material. However, even the handling of these tapes, bands or webs must be delicate, and care must be taken to maintain the parallelity of the boron threads and to ensure perfect juxtaposition.

Some advantage can be gained by providing woven tapes using the boron threads as the warp (60 threads per transverse centimeter) and a synthetic resin thread as the weft (2 per longitudinal centimeter), the fabric being formed as a tape having a width of say 3 centimeters and the boron threads extending in the longitudinal direction. This woven tape to a large measure retans the disadvantages enumerated above and particularly the need to carefully juxtapose the layers. In practice the fabric tape cannot be satisfactorily used in aeronautical construction, the primary application of such fabric.

OBJECTS OF THE INVENTION

It is therefore an object of the invention to provide an improved boron-fiber fabric.

Another object of the invention is to provide means for supporting difficulty supportable boron fibers in a supportive matrix.

Yet another object of the invention is to provide a boron-containing fabric which has its physical properties in one direction, i.e. a unidirectional fabric.

SUMMARY OF THE INVENTION

The above objects are obtained by constructing a fabric in one dimension of substantially parallel members made of standard weaving and knitting fibers having sufficient tensile strength, absence of fragility and good weavability, readily formable into a fabric. By then interweaving fragile, non-pliant, but very strong boron and boron-containing fibers substantially transversely and substantially at right-angles to the above parallel members, the strong tensile strength, that is, the high modulus of elasticity of boron fibers, comprises a unidirectional mode of the fabric. A warp of synthetic-resin fiber supporting a weft of boron-fibers thus accomplishes this. Fabrics so constructed have industrial durability, strength and excellent refractory characteristics. Thus, boron whiskers and boron threads which are difficultly weavable of themselves, can be formed into a very serviceable industrial fabric.

More particularly the aforedescribed disadvantages have been obviated by providing a web of a woven fabric (having a width in excess of, say, 100 centimeters) which is composed of an open warp of synthetic-resin threads (2 to 20 per transverse centimeter) which extend continuously the full length of the web and, interwoven therewith, a dense weft (90 threads per longitudinal centimeter or more) of boron threads which may extend continuously the full width of the fabric or over two or more passes thereacross. The boron threads preferably pass over and under alternate warp threads and the boron threads, individually or in groups, are alternately overshot and undershot by the warp threads. The resulting fabric, when impregnated with a synthetic resin and/or laminated between synthetic resin foils has been found to be especially advantageous for airframe, fuselage and airfoil constructions of light weight and high strength.

DESCRIPTION OF THE DRAWING

The above and other objects, features and advantages will become more readily apparent from the following description, reference being made to the accompanying drawing, in which.

SPECIFIC DESCRIPTION

Figure 1:
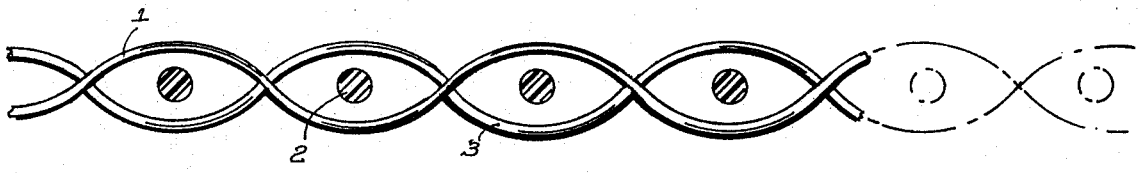
FIG. 1 is a transverse section through a fabric according to the first embodiment of the invention.

FIG. 1 shows a fabric constructed of substantially parallel synthetic-resin filaments 2 formed into a warp of relatively open structure (e.g. 2 to 20 threads/centimeters). These warp elements 2 can also be made not only of synthetic resin fibers (monofilament or polyfilament, polyamide or polyester), but also in whole or in part natural fibers (silk, linen, jute, hemp, cotton or wool), metallic filaments (e.g. tungsten, steel), glass fibers and mineral fibers (e.g. asbestos or graphite) and do not contain boron materials. Into the warp structure 2, a dense woof of boron fiber is woven by conventional heddle loom methods using shedding of the warp wherein a weft strand of boron fiber 1 is woven substantially transversely and substantially orthogonally to the warp 2. The weft density is 90 threads/centimeter or greater. The function of the warp 2 is mainly cohesive and supportive to provide structure and orientation to the boron fiber weft 1. Strands of boron fiber 3 are alternately interwoven on the warp 1. The alternating boron weft fiber 3 is interweaved substantially transversely and substantially orthogonally to the warp 2. Adhesives may be used on warp 2 and weft 1 and weft 3 and the resulting fabric, having a width of 100 to 170 centimeters and an unlimited length, may be impregnated with epoxy or other settable resin.

Figure 2:
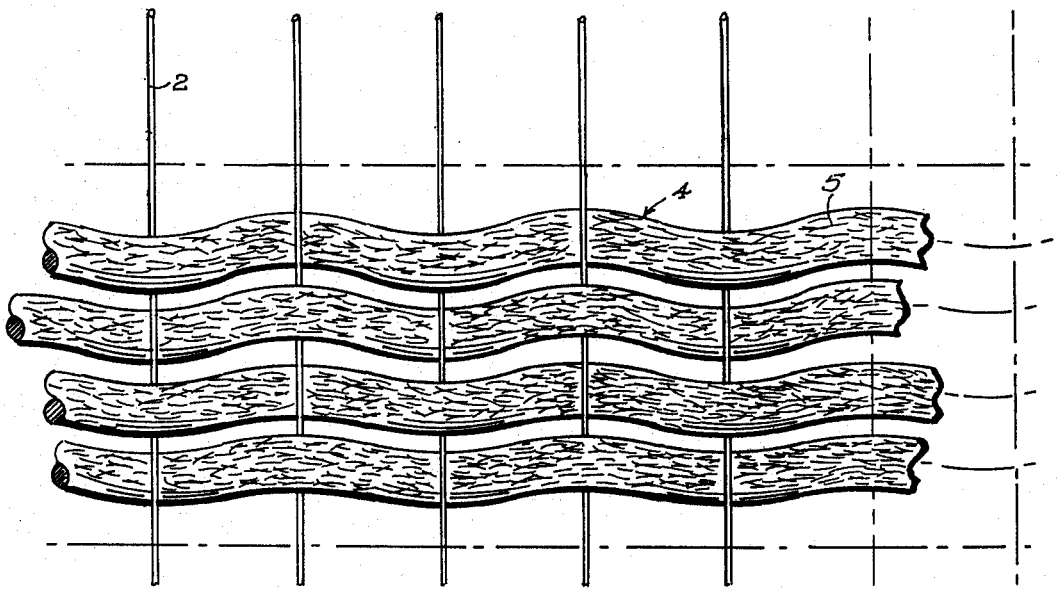
FIG. 2 is a plan view of a fabric as a second embodiment.

FIG. 2 shows a second embodiment which instead of using a single thread of boron in the weft, as at 1 and 3 of FIG. 1, a heavy roving 4 constructed of boron fibers 5 is used. The boron weft fibers 5 can be boron whiskers grown the full length of the fabric. The boron weft fibers 5 can be filamentary elemental boron produced from molten, blown or extruded boron.

Figure 3:
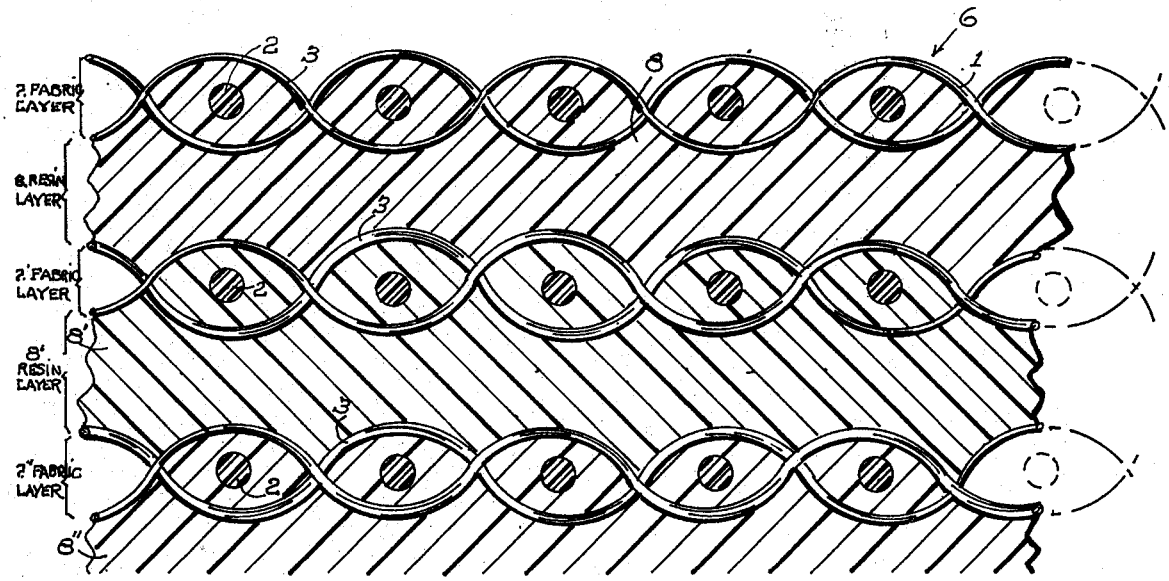
FIG. 3 is a transverse section through a laminated material according to the invention.

FIG. 3 shows a system wherein a laminated material 6 is composed of alternate layers 7 of fabric sandwiching a resin layer 8. The fabric layers 7 and 7', etc. can be of materials shown in FIG. 1 and FIG. 2 and combinations thereof. In FIG. 3, the fabric layer 7 is composed of a warp of substantially parallel threads 2 of synthetic plastic fibers 2 and a weft 2 and 3 composed of boron fibers, threads or a boron roving weft 5. Resin 8 (e.g. epoxy) is located between boron fabric layer 7 and boron fabric layer 7'. Resin 8' is located between boron fabric layer 7' and boron fabric layer 7''. 8'' is a third resin layer, etc.

SPECIFIC EXAMPLE

A fabric web is formed of a width of 100 to 170 centimeters by weaving boron threads with a thread density of 94 threads/centimeter into a warp formed of a polyester fiber (2 threads/centimeter) having the function of supplying cohesion and support to boron fibers incorporated in the weft. The full high resistance, and tensile strength of boron results, mainly from the very high modulus of elasticity of boron and boron-compound fibers. Resistance to wear and good tensionability are assured by having said threads substantially parallel in the weft, held thusly by the warp. Storage of this product can be in a normal atmosphere, aging improvement occurs over the prior art fabric and non-woven materials described above and the workability during weaving and knitting is rapid and easy. The fabric is impregnated with epoxy resin, laminated in 2 to 4 layers and shaped into an airfoil of high strength and light weight.

I claim:

1. A unidirectionally tensionable and reinforced fabric having a woven body formed by a low-density open warp consisting of natural or synthetic threads and having a density of 2 to 20 threads per cm, the threads of said warp being substantially parallel; and a high density planar weft of spaced-apart single boron threads interwoven with and substantially orthogonal to the warp, said boron threads being held together exclusively in a single layer in side-by-side relation, said weft having a density of at least 90 threads per cm.

2. The fabric defined in claim 1, further comprising at least one layer of synthetic-resin laminated to said body to form a stratified material.

3. The fabric defined in claim 1 wherein said body has a width of at least 100 cm.

4. The fabric defined in claim 3 wherein said weft has a density of 94 threads per cm.

5. The fabric defined in claim 1 further comprising a synthetic-resin impregnating said body.

6. The fabric defined in claim 1 wherein said warp is composed of synthetic-resin threads.

7. The fabric defined in claim 1 constituting part of and incorporated in an aeronautical structure.

* * * * *